US009447348B2

(12) United States Patent
Olliges

(10) Patent No.: US 9,447,348 B2
(45) Date of Patent: Sep. 20, 2016

(54) USE OF HEXYLENE GLYCOL ADDITIVE CONTAINING BORIC ACID FOR REDUCING FRICTION AND CORROSION IN INTERNAL COMBUSTION ENGINE CRANKCASES

(76) Inventor: William E. Olliges, Palm City, FL (US)

( * ) Notice: Subject to any disclaimer, the term of this patent is extended or adjusted under 35 U.S.C. 154(b) by 1010 days.

(21) Appl. No.: 13/421,160

(22) Filed: Mar. 15, 2012

(65) Prior Publication Data

US 2013/0239464 A1 Sep. 19, 2013

(51) Int. Cl.

| | |
|---|---|
| ***C10L 1/18*** | (2006.01) |
| ***C10L 1/12*** | (2006.01) |
| ***C10L 1/30*** | (2006.01) |
| ***C10L 1/182*** | (2006.01) |
| ***C10L 1/10*** | (2006.01) |
| ***C10L 10/08*** | (2006.01) |

(52) U.S. Cl.

CPC ..... *C10L 1/1826* (2013.01); *C10L 1/10* (2013.01); *C10L 1/1291* (2013.01); *C10L 10/08* (2013.01); *C10L 2230/22* (2013.01); *C10L 2270/02* (2013.01)

(58) Field of Classification Search

CPC .... C10L 1/1291; C10L 1/1826; C10L 10/08; C10L 1/10; C10L 2230/22; C10L 2270/02

USPC ..... 44/308, 318, 319

See application file for complete search history.

(56) References Cited

U.S. PATENT DOCUMENTS

| | | | | |
|---|---|---|---|---|
| 2,795,548 | A * | 6/1957 | Thomas | C07F 5/04 252/389.41 |
| 2,848,312 | A * | 8/1958 | Liao | 44/319 |
| 3,052,531 | A * | 9/1962 | Jackson et al. | 44/314 |
| 5,652,201 | A * | 7/1997 | Papay et al. | 508/228 |
| 6,368,369 | B1 | 4/2002 | Sanduja et al. | |
| 6,645,262 | B1 | 11/2003 | Sanduja et al. | |
| 7,419,515 | B2 | 9/2008 | Olliges | |
| 7,494,959 | B2 | 2/2009 | Olliges | |
| 7,598,210 | B2 | 10/2009 | Olliges | |
| 7,972,393 | B2 | 7/2011 | Olliges | |
| 2007/0021310 | A1 | 1/2007 | Olliges et al. | |
| 2007/0033862 | A1 | 2/2007 | Olliges | |
| 2007/0037714 | A1 | 2/2007 | Olliges | |
| 2008/0200356 | A1 | 8/2008 | Olliges | |
| 2011/0015104 | A1 | 1/2011 | Olliges | |
| 2011/0036262 | A1 | 2/2011 | Olliges et al. | |

FOREIGN PATENT DOCUMENTS

| | | |
|---|---|---|
| WO | WO0153435 | 7/2001 |

* cited by examiner

*Primary Examiner* — Latosha Hines

(74) *Attorney, Agent, or Firm* — McHale & Slavin P.A.

(57) ABSTRACT

The present invention relates to an engine oil fuel additive that has the characteristics of reducing friction, corrosion, and wear in internal combustion engines. Reduction of engine wear and degradation due to friction and deposit formation is expected to result in increased engine efficiency, extension of engine life, and reduction in repair and maintenance costs.

13 Claims, No Drawings

USE OF HEXYLENE GLYCOL ADDITIVE CONTAINING BORIC ACID FOR REDUCING FRICTION AND CORROSION IN INTERNAL COMBUSTION ENGINE CRANKCASES

CROSS REFERENCE TO RELATED APPLICATIONS

The present invention is related to U.S. patent application Ser. No. 13/421,108 entitled, "HEXYLENE GLYCOL FUEL ADDITIVE CONTAINING BORIC ACID FOR INHIBITING PHASE SEPARATION AND CORROSION IN ETHANOL BLENDED FUELS", filed on Mar. 15, 2012, and U.S. patent application Ser. No. 13/421,134 entitled, "USE OF HEXYLENE GLYCOL FUEL ADDITIVE CONTAINING BORIC OXIDE AS AN ENGINE LUBRICANT", filed on Mar. 15, 2012.

FIELD OF THE INVENTION

The present invention relates to fuel compositions, and more particularly a novel engine lubricant that reduces friction, corrosion and wear in internal combustion engines.

BACKGROUND OF THE INVENTION

Petroleum-based fuel prices in the United Sates continue to rise, causing economical pain to both businesses and consumers. Several reasons have been cited for the increasingly high prices seen at the gas pump. The United States continues to be one of the world's largest users of petroleum-based fuel. It is estimated the U.S. uses 18-20 million barrels of crude oil a day. As other countries such as China and India become more industrialized, they compete for oil resulting in increases in the price of gas prices increase. Over the past several decades, the U.S. has steadily decreased its domestic production, creating increased dependency on foreign oil sources and fluctuating prices which are not always controllable. Exploring and drilling for new sources of domestic oil may be a mechanism to reduce the country's dependence on foreign oil. However, environmental concerns regarding the use of fossil fuels, i.e. increased levels of carbon dioxide emissions believed to contribute to the global warming phenomenon, have contributed to increased efforts for the development of alternative petroleum-based fuel sources.

Energy portfolios of the United States, as well as other industrialized nations, must be adapted to account for increased energy costs resulting from increased competition for limited resources as well as demand for cleaner fuels.

Additionally, means to increase the efficiency of vehicles using traditional as well as non-traditional fuel sources are needed to insure that such vehicles are running as efficiently as possible. Engine lubricants and fuel additives containing boric acid or boric oxide have been used to provide a means for improving lubricity in order to increase engine efficiency for years. While the use of such materials has shown promise, engine oils or lubricants developed form suspensions or emulsions as the boric acid or boric oxide is not easily or fully dissolved and tends to separate. Use of a nanotechnology to decease the size of the boric acid/boric oxide particles have improved the separation problem, however, such techniques are time consuming, expensive, and still suffers from the possibility of particle separation.

Therefore, what is needed in the art is an engine lubricant formulation applied to internal combustion engines which is cheap and easy to produce, forms a solution to prevent particle separation, and is formulated to reduce friction, corrosion, and wear in the internal combustion engines.

DESCRIPTION OF THE PRIOR ART

Use of boric acid and/or boric oxide in fuels and as engine lubricants is known in the art. For example, U.S. Pat. No. 7,972,393 describes a multiphase distillate fuel composition. The composition includes an emulsion comprising a first phase comprising a diesel fuel, a second phase comprising glycerol and boric acid, and a surfactant.

U.S. Pat. No. 7,598,210 describes a lubricant composition for high temperature application. The lubricant contains a desirable combination of high temperature and oxidative stability. The lubricant composition includes a neopolyol ester, boron nitride powder, and a linker/surfactant.

U.S. Pat. No. 7,494,959 describes stable boric acid-containing lubricant compositions which are described as being capable of increasing the efficiency and performance of engines and other machines. The multiphase lubricant compositions are formed of an emulsion containing a first phase comprised of the lubricant, a second phase containing boric acid and a liquid, such as an organic liquid, that is a solvent for boric acid, but immiscible in the first phase, and a surfactant. The liquid is described as being can be an organic liquid, such as a lower alkyl polyol, preferably glycerol, ethyl acetate, acetone, and alcohols such as methanol, ethanol, 1-propanol, 2-methyl-1-propanol, and 3-methyl-1-butanol or an inorganic liquid, such as glacial acetic acid or water, with glycerol being preferred.

U.S. Pat. No. 7,419,515 describes a multiphase distillate fuel composition comprising an emulsion containing a first phase comprised of a distillate fuel, a second phase, the second phase comprised of boric acid and an organic liquid that is a solvent for boric acid, but immiscible in the first phase, and a surfactant.

U.S. Pat. No. 6,645,262 describes liquid hydrocarbon fuel concentrates, including low sulfur liquid hydrocarbon fuel concentrates containing at least 5,000 ppm boric acid suspended in the liquid hydrocarbon fuel. Also disclosed are liquid hydrocarbon fuel compositions formed by diluting the concentrate to form compositions containing only from about 10 ppm to about 50,000 ppm boric acid as well as liquid hydrocarbon fuel compositions formed of a reaction product of boric acid having a particle size of about 65 microns or less, associated with a liquid hydrocarbon fuel having a monomer or prepolymer chemically grafted thereon.

U.S. Pat. No. 6,368,369 describes liquid hydrocarbon fuel concentrates containing from about 50,000 ppm to about 250,000 ppm particulate boric acid, based on the total weight of the concentrate, suspended in a liquid hydrocarbon fuel. The liquid hydrocarbon fuel is described as containing less than 500 ppm or less than 300 ppm sulfur, or even substantially no sulfur.

United States Patent Application 2011/0036262 describes structural coating comprising a liquid carrier, a borate-based additive, and a dynamic stabilization material. The borate-based additive is described as providing corrosion protection through electrochemical binding of active surface corrosive sites, lubrication enhancement through the creation and re-supply to a surface where friction contact occasionally occurs of a weak slip lane crystalline material which may be a locally formed product utilizing local atmospheric humidity, and a material for reaction with an initiator to provide for freezing point depression during coating application. The dynamic stabilization material creates a balance of stabilized material for supply of corrosion protection product, lubrication reduction product, and freezing point depression product.

United States Patent Application 2011/0015104 describes a composition including a lubricant comprising at least one of a hydrocarbon oil or grease, a surfactant, an ester of adipic acid, and a suspension of boric acid.

United States Patent Application 2007/0021310 describes structural coating comprising a polymeric resin, a borate-based additive, and a dynamic stabilization material. The borate-based additive is described as providing corrosion protection through electrochemical binding of active surface corrosive sites, lubrication enhancement through the creation and re-supply to a surface where friction contact occasionally occurs of a weak slip lane crystalline material which may be a locally formed product utilizing local atmospheric humidity, and a material for reaction with an initiator to provide for freezing point depression during coating application.

SUMMARY OF THE INVENTION

The present invention relates to an engine lubricant formulation designed to improve internal combustion engine efficiencies. The additive has the characteristics of reducing friction, corrosion, and wear in internal combustion engines. Reduction of engine wear and degradation due to friction and deposit formation results in 1) improved engine efficiency, 2) extension of engine life, and 3) reduction of repair and maintenance costs. The engine lubricant formulation in accordance with the present invention is a formulation of hexylene glycol and boric acid. The hexylene glycol acts as a solvent for the boric acid to provide a homogenous solution.

Accordingly, it is an objective of the present invention to provide an engine lubricant formulation.

It is a further objective of the present invention to provide an engine lubricant formulation containing a mixture of hexylene glycol and boric acid.

It is a still further objective of the present invention to provide an engine additive lubricant formulation containing a mixture of hexylene glycol and boric acid which reduces wear in internal combustion engines running on hydrocarbon fuels.

It is a further objective of the present invention to provide a method of using a novel fuel engine lubricant containing a mixture of hexylene glycol and boric acid.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

While the present invention is susceptible of embodiment in various forms, there is described a presently preferred, albeit not limiting, embodiment with the understanding that the present disclosure is to be considered an exemplification of the present invention and is not intended to limit the invention to the specific embodiments illustrated.

The present invention is directed to a fuel based additive and/or engine lubricant containing EBF phase separation inhibition and/or reversal properties as well as moving metal surface antifriction and antiwear characteristics and method of using the additive as an engine lubricant. The novel coupling of hydrocarbons and boric acid engine lubricant comprises hexylene glycol and dispersants in the formulation. Moreover, the hexylene solution additive formulation also provides a delivery mechanism for boron compounds that protects and reduces friction and wear between metal surfaces in internal combustion engines. Accordingly, the novel liquid hydrocarbon engine lubricant will increase engine performance and efficiency and reduce engine emissions, green house gases and other environmental pollutants.

Hexylene glycol, having the formula of $CH_3CH(OH)CH_2C(CH_3)_2OH$, and IUPAC name 2-methylpentane-2,4-diol is a member of the glycol family. While hexylene glycol has been used extensively in paints and cosmetics, use as a coupler in engine lubricant blends or as a solvent for boric acid is not known. Several characteristic make it an ideal candidate for an environmentally friendly phase engine lubricant. It is a clear and odorless liquid at room temperature and has been determined to have low acute toxicity to mammals and aquatic organisms.

In a preferred embodiment of the present invention, the hexylene glycol additive solution further contains boric acid ($H_3BO_3$). Boric acid is an environmentally safe compound which has been found to have the capacity to enhance anti-friction and anti-wear properties of sliding metals. Boric acid is a crystalline compound which is insoluble in hydrocarbons and has been used as a lubricant. However, unlike use in previous lubricants where the boric acid formed a suspension, dispersion and/or emulsion, the hexylene glycol acts as a solvent for the boric acid so that the solvent and the solute are homogeneously mixed. Mixed in the right proportions, such as 0.1%-15% by weight boric acid, and preferably from about 1%-4% by weight boric acid, and more preferably from about 13% by weight boric acid, with the hexylene glycol, the boric acid reacts chemically with metallic substrates to form a highly adhesive 0.5 micron thick crystal lattice structure of boric acid platelets that eliminates metal to metal contact, thereby resisting corrosion. The platelets align themselves parallel to the metal surface conforming to the direction of movement and resulting in decreased friction. If the boric acid film is scratched or sheared, it will immediately begin to self-renew in the presence of systemic moisture and oxygen. The solution may also contain additional components, including but not limited to a dispersant, such as Hypermer™ LP-1 dispersant (Croda International) to slow down precipitation for solutions under thermal conditions.

One of the unique aspects of the hexylene glycol additive solution in accordance with the present invention is the fact that hexylene glycol acts as a solvent for the boric acid allowing the formation of liquid delivery system of boron. Such property allows the hexylene glycol additive solution to be formulated to provide an engine lubricant additive to reduce fuel use and to extend the life of the moving metal parts of a vehicle engine. In contrast to known prior art engine lubricants that use boric acid which form emulsions or suspensions subject to particle separation, the unique formulations in accordance with the present invention is not subject to particle separation. As an illustrative example, about 13% by weight boric acid powder is dissolved in hexylene glycol at 150 degrees F. under high shear blending for 15 to 30 minutes to form the hexylene glycol additive solution. The hexylene glycol additive solution can be combined with other components such as petroleum-based and non-petroleum synthesized chemical compounds, including oils, such as motor oils (such as blended mixtures of hydrocarbons, polyalphaolefins, polyinternal olefins) and/or gear oils. The hexylene glycol additive solution can be added in an effective amount to act as a fuel lubricant. For example, when formulated with motor oils or gear oils, the hexylene glycol additive solution may be used in a range of 0.5% to about 15%, preferably 10%, or in a ratio of about 1:10 hexylene glycol additive:oil.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method of reducing fuel use and lubricating one or more components of an engine comprising the steps of:

providing an engine additive hexylene glycol formulation consisting of hexylene glycol and boric acid, said boric acid having a concentration of between 5% and 15% by weight, and mixing said hexylene glycol formulation with a petroleum or non-petroleum synthetic second component to form an engine lubricant.

2. The method of reducing fuel use and lubricating one or more components of an engine according to claim 1 wherein said hexylene glycol formulation contains boric acid having a concentration of about 13% by weight.

3. The method of reducing fuel use and lubricating one or more components of an engine according to claim 1 wherein said petroleum based or non-petroleum synthetic second component contains hydrocarbons, olefins, or combinations thereof.

4. The method of reducing fuel use and lubricating one or more components of an engine according to claim 3 wherein said second component is a motor oil or gear oil.

5. The method of reducing fuel use and lubricating one or more components of an engine according to claim 4 wherein the hexylene glycol formulation:oil ratio is about 1:10.

6. The method of reducing fuel use and lubricating one or more components of an engine according to claim 3 further including the step of delivering said lubricant to one or more parts of an engine.

7. The method of reducing fuel use and lubricating one or more components of an engine according to claim 5 further including the step of delivering said lubricant to one or more parts of an engine.

8. A method of reducing fuel use and lubricating one or more components of an engine comprising the steps of:

forming an engine additive hexylene glycol formulation consisting of hexylene glycol and boric acid, said boric acid having a concentration of between 5% and 15% by weight, and mixing said hexylene glycol formulation with a petroleum or non-petroleum synthetic second component to form an engine lubricant.

9. The method of reducing fuel use and lubricating one or more components of an engine according to claim 8 wherein the hexylene glycol formulation is mixed with said second component in a hexylene glycol formulation:petroleum or non-petroleum synthetic second component ratio of 1:10.

10. The method of reducing fuel use and lubricating one or more components of an engine according to claim 8 wherein said second component is a motor oil or gear oil.

11. The method of reducing fuel use and lubricating one or more components of an engine according to claim 10 wherein the hexylene glycol formulation:oil ratio is about 1:10.

12. The method of reducing fuel use and lubricating one or more components of an engine according to claim 8 further including the step of delivering said lubricant to one or more parts of an engine.

13. The method of reducing fuel use and lubricating one or more components of an engine according to claim 11 further including the step of delivering said lubricant to one or more parts of an engine.

* * * * *